United States Patent [19]

Wilson et al.

[11] 4,179,877

[45] Dec. 25, 1979

[54] PORTABLE, VEHICLE-MOUNTED, SELF-CONTAINED ALARM CLOCK

[75] Inventors: Woodrow A. Wilson, Longview, Tex.; Herschel O. Koska, P.O. Box 5937, Longview, Tex. 75604

[73] Assignee: Herschel O. Koska, Longview, Tex.; by said Woodrow A. Wilson

[21] Appl. No.: 800,923

[22] Filed: May 26, 1977

[51] Int. Cl.[2] ..... G04B 37/14

[52] U.S. Cl. ..... 58/56; 206/301; 224/903; 248/114

[58] Field of Search ..... 206/301, 18, 70; 58/53, 58/54, 55, 56; 361/371, 391, 427, 429; 339/39, 40, 41, 42, 70, 71, 72, 90 R, 90 M; 224/29 H, 29 K, 42.44, 4 A, 4 R; 248/114, 115, 116

[56] References Cited

U.S. PATENT DOCUMENTS

| | | | |
|---|---|---|---|
| 1,292,043 | 10/1917 | Porter | 58/56 |
| 3,061,761 | 10/1962 | Blain | 339/92 M |

*Primary Examiner*—Gene Z. Rubinson

*Assistant Examiner*—Leonard W. Pojunas, Jr.

*Attorney, Agent, or Firm*—Clarence A. O'Brien; Harvey B. Jacobson

[57] ABSTRACT

A mounting structure incorporated into the dashboard of an automotive vehicle or the like for removably supporting a portable, self-contained, battery operated alarm clock to enable the clock to be easily mounted in the dashboard and just as easily removed therefrom to enable the clock to be used in the vehicle in a customary manner and removed therefrom and carried to any desired location for use as a portable alarm clock having general utility. The clock is especially useful by travelers since it can be taken out of the automobile and into the motel or hotel room so that it can be used as an alarm clock. The mounting structure and clock are uniquely associated so that the clock may be easily inserted but yet securely retained in the vehicle dashboard even when traversing rough or uneven roadways and the like with a manually manipulated structure enabling easy removal of the clock from its secure position in the dashboard.

4 Claims, 8 Drawing Figures

PORTABLE, VEHICLE-MOUNTED, SELF-CONTAINED ALARM CLOCK

BACKGROUND OF THE INVENTION

1. Field of the Invention

The present invention generally relates to a portable, self-contained, vehicle mounted clock in which a mounting structure in the form of a receptacle for the clock is mounted in the dashboard of a vehicle with the interrelation between the clock and mounting structure assuring secure mounting of the clock but yet enabling easy removal thereof so that the vehicle operator may easily remove and insert the clock so that it may be taken with the vehicle operator when he is out of the vehicle for enabling the vehicle operator to use the clock for any desired time indicating purposes.

2. Description of the Prior Art

Vehicles have been provided with various types of clocks, many of which are connected with the electrical system of a vehicle for operation. Such clocks are quite expensive, require considerable maintenance and considerable labor is required to remove such a clock, have it repaired and then reinstalled. Also, portable windup traveling clocks are well known which are conveniently used by individuals who travel frequently or who frequent areas not normally provided with a clock. In recent years, portable clock mechanisms which are battery powered have been developed which are relatively compact and have a relatively long battery life. Such clocks or clock works may include an alarm device, various types of solid state circuitry and readouts as well as selectively operated illuminating means. The development of the prior art in this field of endeavor is illustrated in the following representative U.S. patents. U.S. Pat. Nos: 1,137,032—Apr. 27, 1915; 1,158,611—Nov. 2, 1915; 1,428,902—Sep. 12, 1922; 1,497,922—June 17, 1924; 1,639,598—Aug. 16, 1927; 2,874,531—Feb. 24, 1959; 3,996,736—Dec. 14, 1976.

SUMMARY OF THE INVENTION

An object of the present invention is to provide a portable, vehicle-mounted, self-contained alarm clock adapted to be mounted in the dashboard of an automobile or similar vehicle with a mounting structure enabling source mounting of the clock but easy removal thereof so that the clock may be carried to a different location for use as a time indicator or alarm clock.

Another object of the invention is to provide a clock in accordance with the preceding object in which the mounting structure for the clock is in the form of a receptacle inserted through and secured fixedly in an opening in the dashboard with the clock completely filling the opening and being removably telescoped into the receptacle.

A further object of the invention is to provide a clock in accordance with the preceding objects in which the clock and receptacle include interengaging means for securing the clock in position and a manually operable means to release the clock from the receptacle to enable it to be carried to a desired location.

Still another important object of the invention is to provide a clock and mounting structure therefor which can be easily installed in various types of vehicles and standardized as to structure and configuration for enabling the initial cost and repair cost of such clocks to be reduced to a minimum and materially enhancing the utility of a vehicle mounted clock by enabling it to be used as a general purpose time piece or alarm clock, since it can be easily removed from the vehicle dashboard and carried to a desired location by the vehicle operator or passenger.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
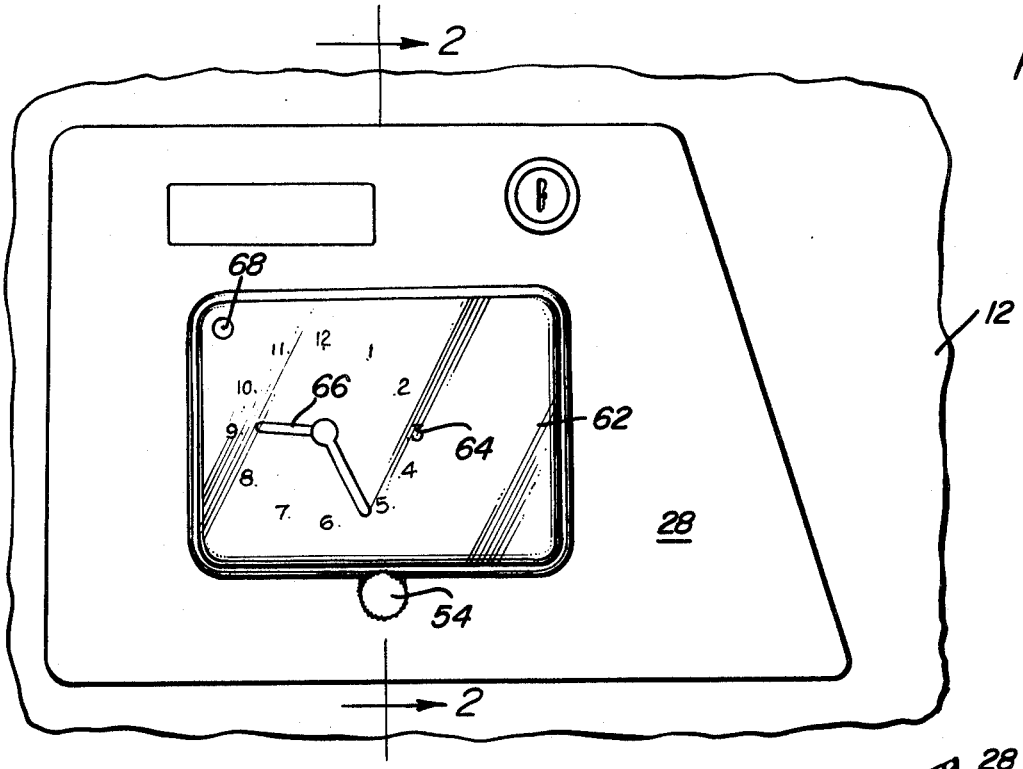
FIG. 1 is an elevational view of a section of a vehicle dashboard illustrating the clock mounted in a panel forming a portion thereof.

Referring now specifically to the drawings, a self-contained, portable, battery operated clock 10 is supported in the dashboard 12 of an automobile or similar vehicle by the use of a mounting receptacle therefor generally designated by the numeral 14 and which is in the form of a mounting receptacle or supporting receptacle in the form of a horizontally disposed parallelepiped box-like structure defined by generally rectangular, opposed parallel top and bottom walls 16 and 18, parallel, generally rectangular opposite side walls 20 of identical construction and a vertically disposed, generally rectangular, rear wall or inner wall 22, thus leaving the opposite end of the box-like structure open to form an opening designated by numeral 24 to enable insertion of and removal of the clock 10. As illustrated, the periphery of the opening 24 is defined by an outwardly extending peripheral flange 26 which abuts against the outer surface of a panel 28 forming a part of the dashboard 12 when the mounting receptacle 14 is inserted through a correspondingly shaped opening 30 in the panel 28. Most vehicle dashboards include a removable panel, such as the panel 28, so that the clock and mounting structure may be associated with various types of vehicle dashboard panels. Thus, if a vehicle is desired without a clock, a panel 28 without the opening 30 therein will be used or a closure panel for the opening 30 may be utilized with the closure being removable so that at any time a vehicle clock is desired, it is only necessary to remove the closure panel for the opening 30 and insert the mounting receptacle 14 therein, after which the clock may be easily inserted into the mounting receptacle 14. Thus, by providing standard openings 30 in dashboard panels of vehicles, a standardized mounting structure and clock may be used, thus materially reducing the cost of the clock and installation thereof.

Figure 6:
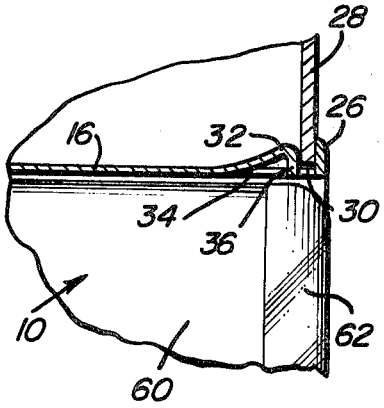
FIG. 6 is a detailed, sectional view, on an enlarged scale, taken substantially upon a plane passing along section line 6—6 on FIG. 4, illustrating the manner in which the mounting receptacle for the clock is supported in the dashboard panel.

In order to secure the mounting receptacle 14 in the opening 30 in panel 28, the top wall 16 and bottom wall 18 is provided with a plurality of outwardly struck tongues 32 formed by parallel slits 34 being cut or lanced in the respective walls with the end of the tongues 32 being deformed outwardly as illustrated in FIG. 6 and then inturned at its free end as indicated by numeral 36, so that the generally flat free end 38 of the tongues 32 will engage the inner surface of the panel 28 adjacent the periphery of the opening 30 in opposed relation to the flange 26 thereby securely locking the receptacle 14 in the dashboard 12 but enabling removal thereof, if necessary, by manually moving the tongues 32 inwardly for alignment with the top wall 16 or bottom wall 18. When the mounting receptacle 14 is mounted on the panel 28, it is merely inserted through the opening 30 with the inclined surfaces of the tongues 32 causing the tongues to cam inwardly and pass through the opening 30 so that as soon as the inner surfaces 38 are in alignment with the inner surface of the panel 28, they will spring outwardly to their locked position as illustrated in FIG. 6. The material from which the receptacle 14 is constructed is inherently resilient and may be metal, plastic, or the like, and the flange 26 may take any suitable shape and configuration and provided with any ornamentation or surface characteristics compatible with the remainder of the vehicle dashboard.

Figure 5:
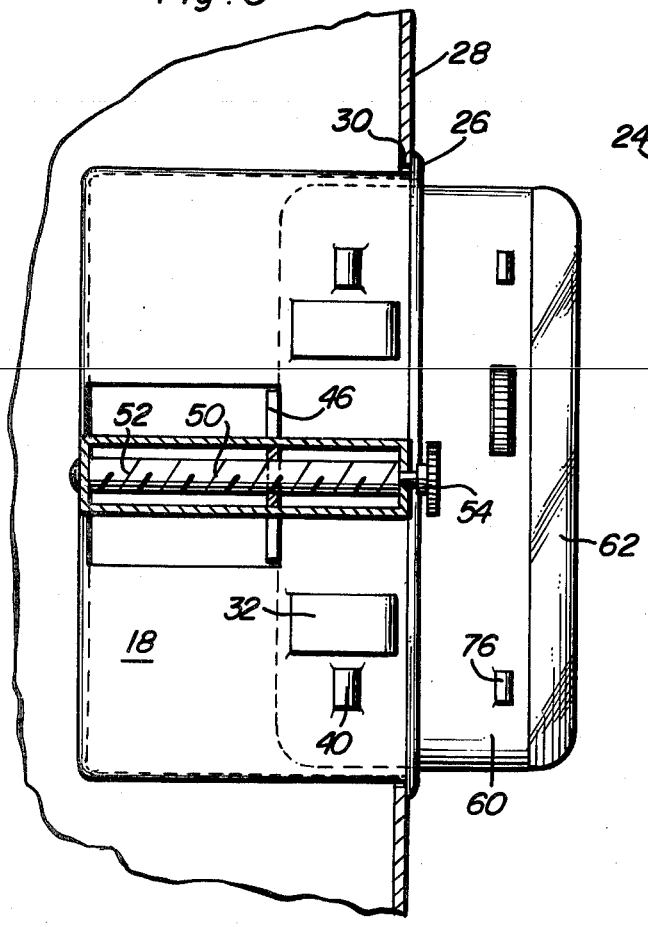
FIG. 5 is a bottom, sectional view taken substantially upon a plane passing along section line 5—5 on FIG. 3 illustrating further structural relationships between the clock and mounting receptacle.
Figure 7:
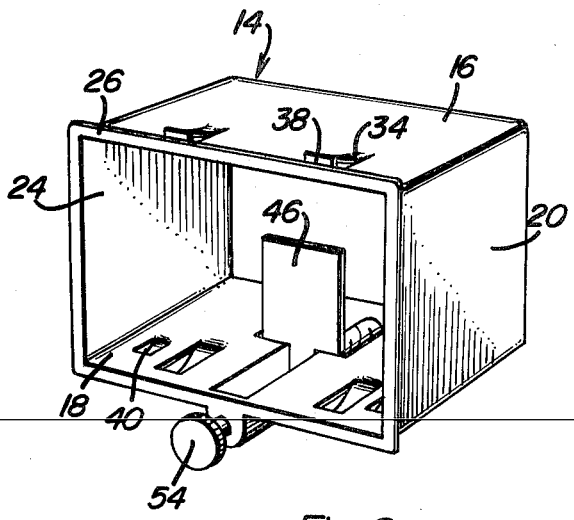
FIG. 7 is a front perspective view of the mounting receptacle for the clock.

The bottom wall 18 is provided with a pair of rather shallow, downwardly extending recesses or pockets 40 adjacent to but spaced inwardly from the edge thereof having the flange 26 thereon, as illustrated in FIGS. 5 and 7. While closed pocket-like recesses 40 are illustrated, the recesses may be in the form of openings formed in the bottom wall 18, for a purpose described hereinafter.

Figure 2:
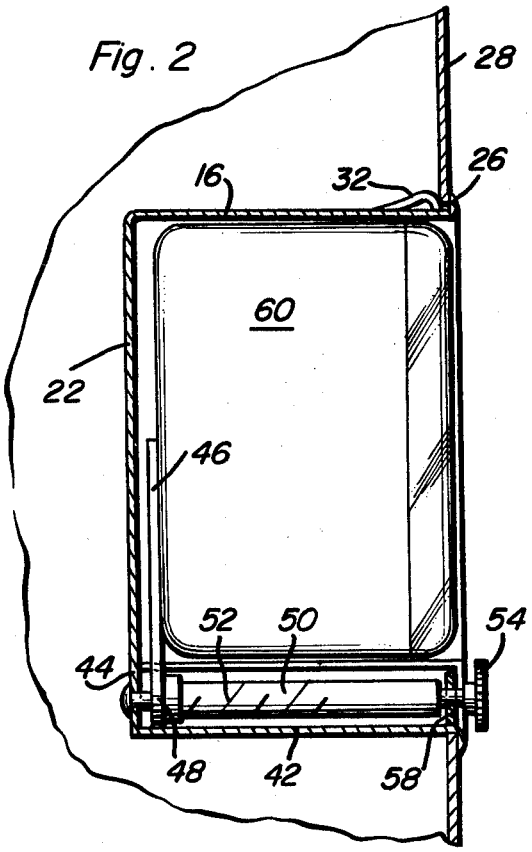
FIG. 2 is a vertical, sectional view taken substantially upon a plane passing along section line 2—2 on FIG. 1 illustrating the clock and its association with the supporting or mounting receptacle therefor.
Figure 3:
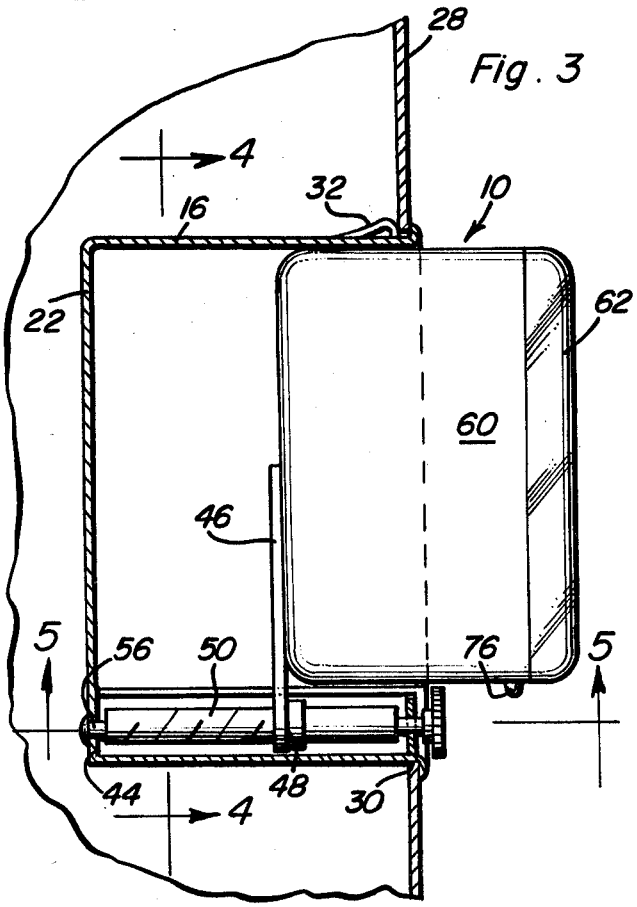
FIG. 3 is a sectional view similar to FIG. 2 but illustrating the clock being moved outwardly of the supporting receptacle by an ejector device.
Figure 4:
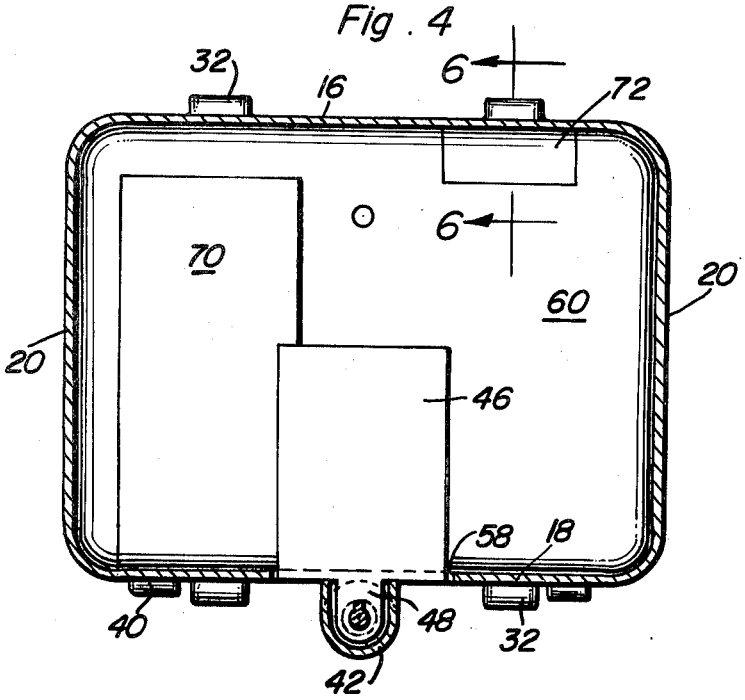
FIG. 4 is a transverse, sectional view taken substantially upon a plane passing along section line 4—4 on FIG. 3, illustrating further structural details of the supporting receptacle and the relationship of the clock thereto.

Also, the bottom wall 18 is provided with a depressed trough or channel 42 formed centrally therein from front to rear with the end of the trough 42 adjacent the rear wall 22 being closed by a short depending closure tab 44 on the rear wall and the forward end of the trough 42 terminates inwardly of the forward edge of the bottom wall 18, as illustrated in FIGS. 2 and 3. Positioned interiorly of the mounting receptacle 14 is an ejector plate 46 which extends vertically in generally parallel relation to the rear wall 22 with a height substantially less than the height of the rear wall 22, as illustrated in FIGS. 2 and 3. The bottom edge of the ejector plate 46 is provided with a centrally disposed depending tab 48 which conforms with and is received in the trough 42, as illustrated in FIG. 4. The tab 48 is mounted on an elongated operating rod 50 journaled in the trough 42 with the rod 50 including a spiral slot or groove 52 thereon having a pitch or lead so that one revolution of the rod 50 will move the ejector plate 46 from its completely retracted position against or adjacent the rear wall 22 to its forwardmost position generally centrally of the fore to aft dimension of the mounting receptacle, as illustrated in FIG. 3. The rod 50 extends slightly forwardly from the lower edge of the mounting receptacle and terminates in a knob 54 having its periphery disposed below the upper surface of the bottom wall 18 and being disposed adjacent the flange 26 so that substantially no protrusion is provided but yet the knob 54 is accessible for rotating the rod 50. The long lead screw, threaded rod or grooved rod 50 provides for movement of the ejector plate between its extreme positions by approximately one revolution of the knob 54. The inner end of the rod 50 is reduced and journaled in the depending closure tab 44 as indicated at 56 and the other end portion of the rod 50 is journaled in a tab, or the like, 58 integral with and depending from the flange 26 or otherwise rigidly fixed to the forward edge of the bottom wall 18. The plate 46 is retained vertically by the lower edge thereof engaging the top edges of the trough 48 and being received in a cutout or recess 58 in the bottom wall 18 with the forward edge of the recess or cutout 58 serving to limit the forward movement of the ejector plate 46. The width of the tab 48 where it engages with the grooved or threaded rod 50 may be such as to provide vertical stability for the plate 46.

Figure 8:
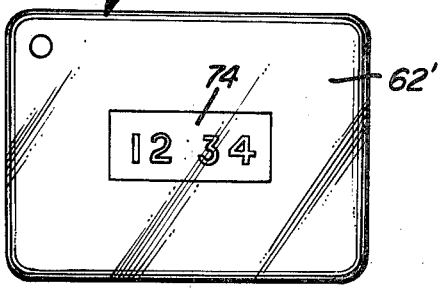
FIG. 8 is a front elevational view illustrating a digital type of clock.

The clock 10 includes a parallelepiped body 60 having external dimensions substantially the same as but slightly less than the internal dimensions of the mounting receptacle 14. The clock body houses the clockworks and the forward end of the body, casing or housing 60 is provided with a transparent front wall member 62 covering a clock face 64 and the usual time indicating indicia and hands 66, including an alarm set indicator, and an illuminating bulb 68 is provided adjacent the clock face or dial 64. The rear of the clock casing 60 is provided with a removable panel 70 to provide access to a changeable battery and the upper portion of the casing of the clock is provided with a lever 72 which is depressible to set the alarm and also to close a switch to actuate the illuminating means which is a spring bias switch so that the light will only stay on as long as finger pressure is exerted downwardly on the operating lever 72. However, when the lever 72 is depressed, it will stay depressed to the extent that it will set the alarm. Adjustment means may be provided for setting the time indicator hands as well as the alarm indicator hand and adjustment means may be provided for accurate adjustment of the time keeping characteristics of the clock and adjustment means is provided for varying the tone of the alarm which rather than being a conventional bell or buzzer will be in the form of a beep sound. The clockworks interiorly of the casing is in the form of a conventional electronic clock, quartz clock, or the like, and the clock face may be in the form of a conventional clock face or the readout may be a digital readout or indicator as designated by numeral 74 in FIG. 8.

The bottom of the clock casing is provided with a pair of relatively short depending projections or supporting feet 76 which supports the clock on a supporting surface in a slightly canted position and which are spaced apart so that they will be received in the recesses 40 when the clock 10 is completely inserted into the mounting receptacle 14, as illustrated in FIG. 2. The clock casing 60 is constructed of rigid but somewhat flexible material such as suitable plastic material which has sufficient flexibility to enable the supporting feet 76 to flex slightly upwardly during insertion and removal of the clock from the mounting receptacle 14 so that the clock will be securely retained in the mounting structure 14 when the feet 76 are received in the recesses 40 but yet the clock can be easily moved outwardly by rotating the knob 56.

In addition to the characteristics of the clock readout being variable, the specific internal clockwork is conventional as is the solid state circuitry and battery mounting structure, and the like.

The clock and its mounting structure is particularly useful in automobiles where conventional clocks are notoriously inaccurate and short-lived. When such a clock is removed, it requires considerable time since the clock has to be disconnected from the electrical system and access is usually necessary to the rear of the dashboard which is normally cluttered with various wiring, and the like. Even after the clock has been removed from the dashboard, it usually requires several weeks for it to be sent to the repair shop and returned and then substantial labor to reinstall the clock. As compared to conventional procedures, this clock, such as a quartz or electronic clock, is much more accurate, usually within several seconds a month, and has a high degree of dependability with the battery lasting at least one year and the removability enables the customer to change the clock, change the style of the clock and use the clock wherever he so desired. For example, it may be used in the automobile, boat, motel, or camping, or wherever else desired.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination, a self-contained, battery operated, portable, alarm clock, a vehicle dashboard panel having an opening therethrough capable of receiving said clock, and means securely and releasably mounting said clock in the panel opening to enable the clock to be supported in the vehicle dashboard panel and readily removed therefrom to enable it to be transported to a desired location for general utility, said clock including a casing receiving the clockworks and a time indicating means visible externally of the casing, said securing means including a mounting receptacle insertable into the panel opening and including an open portion accessible through the panel for telescopically receiving the clock casing, said clock casing and mounting receptacle including coacting recess and projecting means for releasably retaining the clock casing telescoped into the mounting receptacle, said projecting means supporting the clock on a supporting surface when removed from said dashboard, said mounting receptacle including a peripheral flange defining the open portion with the flange projecting outwardly from the periphery of the mounting receptacle for engagement with one surface of the panel adjacent the opening therethrough, resilient retaining means mounted on said receptacle in opposed and closely spaced relation to the flange for engaging the opposite surface of the panel with respect to the flange for retaining the mounting receptacle in the opening with such resilient means being capable of inward movement to enable the mounting receptacle to be inserted through the opening in the panel from the side of the panel which is to be engaged by the flange.

2. The structure as defined in claim 1 wherein said resilient means is in the form of a plurality of outwardly extending tongues having the end thereof remote from the flange rigid with the mounting receptacle and the end thereof adjacent the flange being free of and spaced from the periphery of the mounting receptacle and capable of inward movement toward the receptacle when the receptacle is moved through the panel opening.

3. The structure as defined in claim 1 together with ejecting means mounted on said receptacle and engageable with the clock casing to eject the clock casing from the mounting receptacle, wherein said ejecting means includes a movable ejecting plate mounted in the mounting receptacle, and a manually operated screw shaft means engaged with the plate and being mounted on the receptacle for moving the plate inwardly and outwardly to the relation of the receptacle, said screw shaft means including a knob on the end thereof adjacent the flange and disposed outwardly of the flange for access from the side of the panel engaged by the flange.

4. The structure as defined in claim 1 wherein said projecting means comprises supporting feet spaced apart to support said clock in a slightly canted position on said supporting surface.

* * * * *